US012000238B2

(12) United States Patent
Al-Mousa et al.

(10) Patent No.: US 12,000,238 B2
(45) Date of Patent: Jun. 4, 2024

(54) LATCHING TOOL FLOAT VALVE IN COMBINATION WITH CEMENT RETAINER

(71) Applicant: SAUDI ARABIAN OIL COMPANY, Dhahran (SA)

(72) Inventors: Ahmed Abdulaziz Al-Mousa, Dhahran (SA); Saad M. Budair, Dhahran (SA); Hashim A. Awwami, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/362,580

(22) Filed: Jul. 31, 2023

(65) Prior Publication Data

US 2023/0374886 A1 Nov. 23, 2023

Related U.S. Application Data

(62) Division of application No. 17/682,408, filed on Feb. 28, 2022, now Pat. No. 11,767,733.

(51) Int. Cl.
*E21B 33/14* (2006.01)

(52) U.S. Cl.
CPC ..... *E21B 33/14* (2013.01)

(58) Field of Classification Search
CPC ..... E21B 33/14
See application file for complete search history.

(56) References Cited

U.S. PATENT DOCUMENTS 3,543,849 A * 12/1970 Kilgore ..... E21B 33/14 166/330
2020/0056446 A1* 2/2020 Al-Mousa ..... E21B 33/1293

* cited by examiner

*Primary Examiner* — Angela M DiTrani Leff
*Assistant Examiner* — Avi T Skaist
(74) *Attorney, Agent, or Firm* — Osha Bergman Watanabe & Burton LLP

(57) ABSTRACT

An assembly includes a cement retainer, a unidirectional flow valve, and an upper stinger. The cement retainer is adapted to be mounted in the casing string. The cement retainer has a retainer aperture extending longitudinally therethrough from a retainer top end to a retainer bottom end. The unidirectional flow valve is configured to selectively control flow of fluid through the retainer aperture and is housed within the cement retainer. The upper stinger is configured to be removably retained within the retainer aperture. The upper stinger has an upper stinger aperture extending longitudinally therethrough from an upper stinger top end to an upper stinger bottom end. The upper stinger comprises an opening that provides a fluid flow path from an interior of the casing string to the upper stinger aperture when the upper stinger is removed from the cement retainer.

5 Claims, 7 Drawing Sheets

LATCHING TOOL FLOAT VALVE IN COMBINATION WITH CEMENT RETAINER

BACKGROUND

In the petroleum industry, hydrocarbons are located in porous reservoirs far beneath the Earth's surface. Wells are drilled into these reservoirs to access and produce the hydrocarbons. Drilling a well includes running and cementing casing into the wellbore to isolate formation fluids and provide the mechanical structure of the well. In some cases, a cement job may "fail" resulting in a portion of the annulus that was supposed to be cemented being void of cement. Or, when a well is undergoing a workover operation, a loss of cement behind the casing may be present. When these situations arise, a cement remediation job may be run. There are various types of cement remediation techniques including, for example, top jobs and perforation ("perf") and squeeze jobs. In a perf and squeeze job, a cement retainer may be used to apply a treatment to a lower interval of a casing string while isolating the space above the interval.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in accordance with one or more embodiments, assemblies, systems, and methods for cementing a casing string. The casing string has a portion of an annulus void of cement The assembly includes a cement retainer, a unidirectional flow valve, and an upper stinger. The cement retainer is adapted to be mounted in the casing string. The cement retainer has a retainer aperture extending longitudinally therethrough from a retainer top end to a bottom end. The unidirectional flow valve is configured to selectively control flow of fluid through the retainer aperture and is housed within the cement retainer.

The upper stinger is configured to be removably retained within the retainer aperture. The upper stinger has an upper stinger aperture extending longitudinally therethrough from an upper stinger top end to an upper stinger bottom end. The upper stinger comprises an opening that provides a fluid flow path from an interior of the casing string to the upper stinger aperture when the upper stinger is removed from the cement retainer.

The system includes the assembly, as described above, and a tubing string. The assembly is disposed within the casing string above the portion of the annulus void of cement. The tubing string is connected to the upper stinger top end and extends to a surface location.

The method includes inserting an upper stinger bottom end of an upper stinger into a retainer aperture of a cement retainer. A unidirectional flow valve is located within the retainer aperture. A tubing string, attached to an upper stinger top end of the upper stinger, is run into the casing string. The cement retainer is set within the casing string above the portion of the annulus that is void of cement. Cement is pumped through the tubing string, the upper stinger, the casing string, and the perforations of the casing string into the portion of the annulus that is void of the cement. The upper stinger is disengaged from the cement retainer, and the cement is reverse circulated out of the tubing string through the upper stinger.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
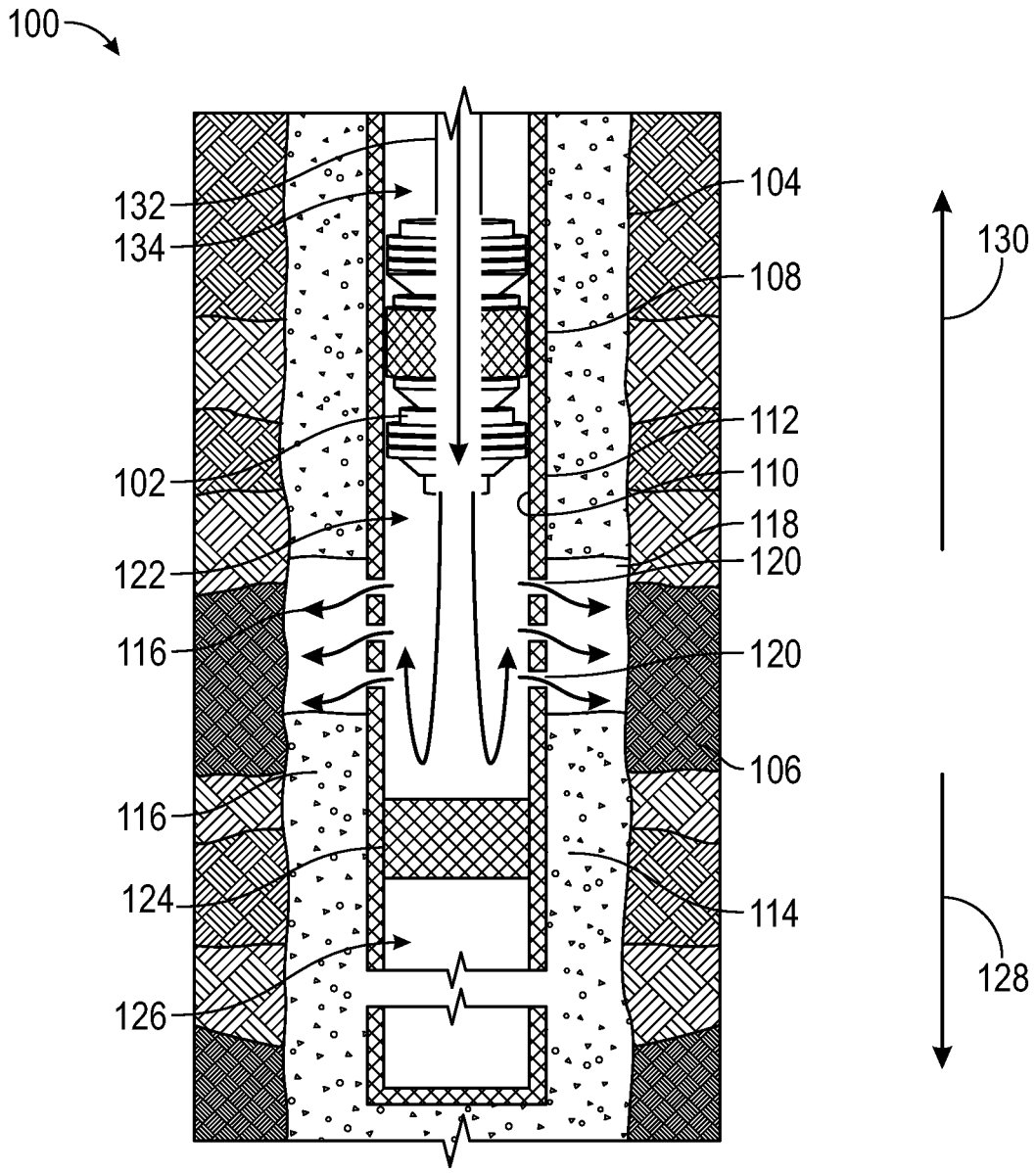
FIG. 1 shows a well system employing a cement retainer in accordance with one or more embodiments.

FIG. 1 shows a well system (100) employing a cement retainer (102) in accordance with one or more embodiments of the disclosure. Specifically, FIG. 1 shows a wellbore (104) that has been drilled into a formation (106). A casing string (108) has been set in the wellbore (104). The casing string (108) has an inner surface (110) and an outer surface (112). The casing string (108) is a string of large-diameter pipe threaded, or elsewise connected, together. The large-diameter pipe may be made of a material that can withstand wellbore (104) pressures and temperatures, such as steel.

An annulus (114) is formed between the outer surface (112) of the casing string (108) and the wellbore (104). As a result of a prior cement job, the annulus is mostly filled with existing cement (116). However, in this example, a portion (118) of the annulus (114) is void of the existing cement (116). The well system (100) depicted in FIG. 1 may represent a well that is in the process of being drilled and completed or a well that has been put on production and is undergoing a workover operation.

A perf and squeeze job is shown being run on the well to fill the portion (118) of the annulus (114) with cement (116). The perforation operation of the perf and squeeze job has already been performed, leaving perforations (120) in a first segment (122) of the casing string (108) adjacent the portion (118) void of cement (116). The perforations (120) place the first segment (122) of the casing string (108) in fluid communication with the portion (118) void of cement (116). The perforation operation may be conducted according to any method known in the art, such as running a perforation gun into the hole, on wireline, and detonating the explosives to create the perforations in the casing string (108).

A plug (124) may be set within the casing string (108). The plug (124) may be any type of plug (124) known in the art, such as a bridge plug (124). The plug (124) isolates a second segment (126) of the casing string (108), located downhole (128) of the plug (124), from the first segment (122) of the casing string (108) located up hole (130) of the plug (124). Herein, up hole (130) is defined as a location or direction towards the surface of the Earth, and downhole (128) is defined as a location or direction within the ground and away from the surface of the Earth. Both up hole (130) and downhole (128) are represented by arrows in FIGS. 1-4B.

In the embodiment shown in FIG. 1, the cement retainer (102) has been run and set in the casing string (108) so as to form a seal against the inner surface (110) of the casing string (108). The cement retainer (102) is run into the casing string (108) using a tubing string (132). The tubing string (132) is a string of smaller-diameter pipe made of a material that can withstand downhole pressures and temperatures, such as steel. The tubing string (132) may be drill pipe or any other type of pipe having a conduit that may supply cement (116) downhole (128). The tubing string (132) has a connecting device, for example a stinger as described in more detail below, that connects and provides fluid communication between the tubing string (132) and the cement retainer (102).

The cement retainer (102) is adapted to be mounted in the casing string (108). The cement retainer (102) may be any cement retainer (102) known in the art that has the ability to isolate the first segment (122) of the casing string (108) from a third segment (134) of the casing string (108) and deliver cement (116) to the first segment (122). The cement retainer (102) is shown disposed and set within the casing string (108) to isolate the first segment (122), located downhole (128) from the cement retainer (102), from the third segment (134) of the casing string (108), located up hole (130) from the cement retainer (102).

FIG. 1 shows cement (116) being forward circulated in the well system (100). Forward circulation is when the fluid is pumped in the downhole (128) direction through the inside of the tubing string (132) and pushed in the up hole (130) direction through the space between the tubing string (132) and the casing string (108). The cement (116) is shown being forward circulated from a surface location (i.e., a location located along the Earth's surface), downhole (128) through the tubing string (132), through the cement retainer (102), and into the first segment (122).

Once the first segment (122) has been filled with cement (116), the cement (116) enters the portion (118) of the annulus (114) through the perforations (120). After the required volume of cement (116) is pumped through the tubing string (132), the tubing string (132) disconnects and pulls out of the cement retainer (102). A fluid, such as drilling mud, is reverse circulated into the third segment (134) of the casing string (108) to remove the cement (116) from the inside of the tubing string (132).

Reverse circulation is when the fluid is pumped in the downhole (128) direction into the casing string (108) and around the outside of the tubing string (132). The pressure of the fluid being pumped pushes the fluid in the up hole (130) direction through the inside of the tubing string (132). The cement (116) that was left inside of the tubing string (132), after completion of the cement (116) placement in the portion (118) of the annulus (114), returns to the surface through the inside of the tubing string (132) and is followed by the fluid. Once all the left-over cement (116) has been returned to the surface, the tubing string (132) may be pulled out of the casing string (108), and the perf and squeeze job is complete.

FIGS. 2A-2D show a cross sectional view of an assembly (200) and components that make up the assembly (200) in accordance with one or more embodiments. The assembly (200) includes a unidirectional valve (202) that permits fluid flow in a first direction and restricts fluid flow in a second direction. The first direction may be in the downhole (128) direction as described in FIG. 1 and the second direction may be in the up hole (130) direction as described in FIG. 1. In accordance with embodiments of the invention, the unidirectional valve (202) may be a float valve such as a flapper/check valve.

In general, unidirectional valves (202) are installed in tubing strings (132) as a well control precaution, because, when a well receives a kick, the unidirectional valve (202) prevents undesired reverse fluid flow toward the surface through the tubing string (132). However, when a cement retainer (102) is run on a tubing string (132) for a cement remediation job, the tubing string (132) conventionally cannot have a unidirectional valve (202) installed due to the need, explained above, to reverse circulate excess cement (116) out of the well. Because of this, a valuable well control mitigation is conventionally unavailable. Embodiments disclosed herein present assemblies, systems, and methods that allow a unidirectional valve (202) to be run on the tubing string (132) in conjunction with the cement retainer (102).

Figure 2A:
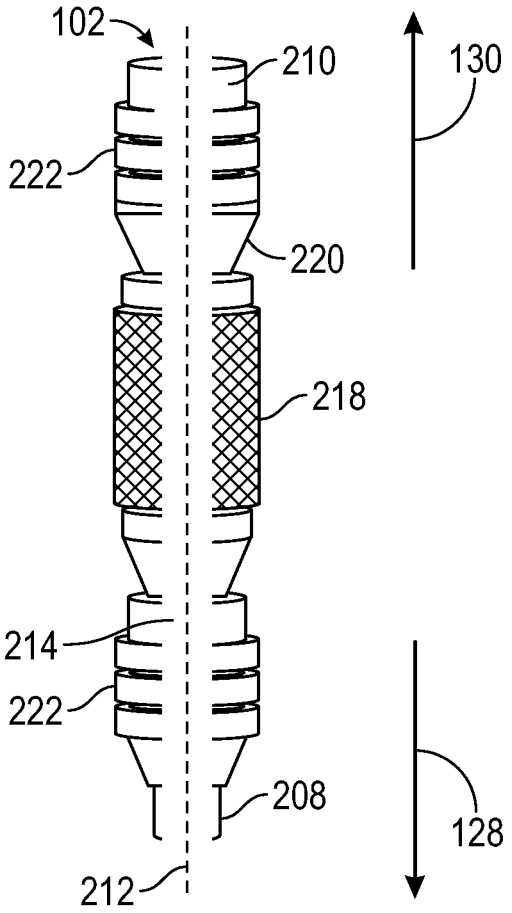
FIGS. 2A-2D show a cross sectional view of an assembly and components that make up the assembly in accordance with one or more embodiments
Figure 2B:
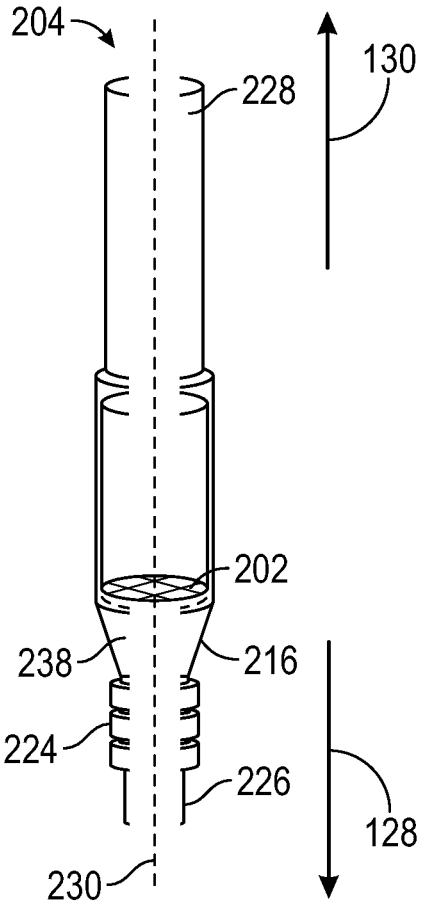
Figure 2C:
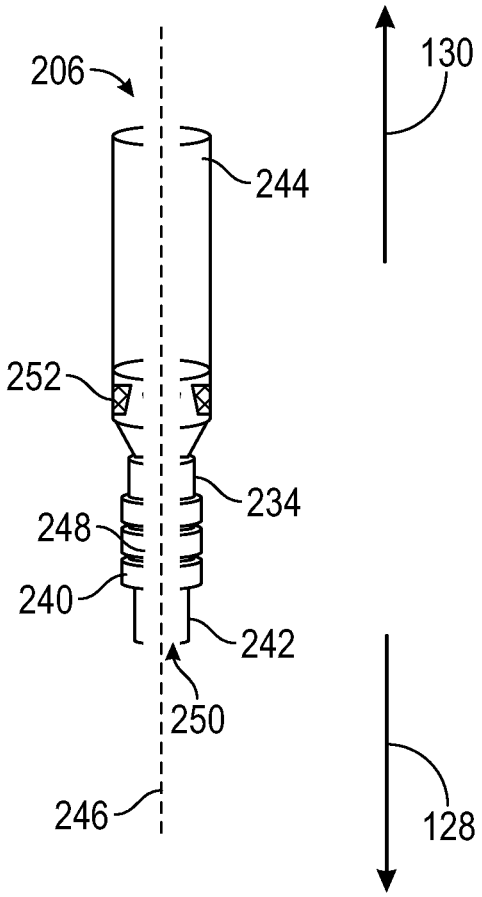
Figure 2D:
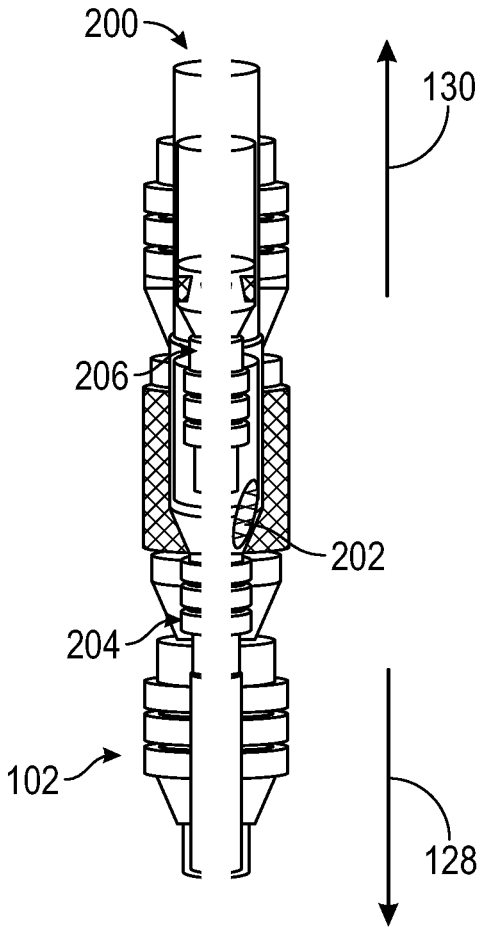

FIGS. 2A-2C show a cement retainer (102), a middle stinger (204), and an upper stinger (206) that make up the assembly (200) shown in FIG. 2D. Specifically, 2*a* shows a cross sectional view of the cement retainer (102). The cement retainer (102) is adapted to be mounted in a casing string (108) such as the casing string (108) of FIG. 1. The cement retainer (102) has a retainer bottom end (208), a retainer top end (210), and a retainer longitudinal axis (212). The cement retainer (102) is made of a tubular body having a retainer aperture (214) extending along the retainer longitudinal axis (212) from the retainer top end (210) to the retainer bottom end (208).

The retainer aperture (214) provides the ability to ensure hydraulic access from the retainer top end (210) to the retainer bottom end (208) when a stinger has been stung into the retainer top end (210). The retainer aperture (214) is shaped such that when the middle stinger (204) is inserted into the retainer aperture (214), a middle stinger exterior peripheral surface (216) of the middle stinger (204) fits flush within the retainer aperture (214). This may mean that the retainer aperture (214) has different diameters and various geometries to seat the middle stinger (204).

A radially expandable sealing surface (218) is disposed around a retainer exterior peripheral surface (220). The radially expandable sealing surface (218) is selectively expandable in a radial, outward direction with respect to the retainer longitudinal axis (212) so as to form a seal against an interior cylindrical surface of another concentric tubing member such as the inner surface (110) of the casing string (108). The radially expandable sealing surface (218) may be actuated by applying pressure on the assembly (200). The pressure may be applied by pumping a fluid into the assembly (200). The radially expandable sealing surface (218) may be deflated by releasing the pressure.

The retainer exterior peripheral surface (220) may also include one or more retainer seals (222). The retainer seals (222) may be any type of seals known in the art, such as a gasket, that aid in sealing against the sealing surface. The retainer seals (222) are close in size to the gauge of the radially expandable sealing surface (218). The retainer seals (222) may be used as secondary seals that operate in the presence of high pressure and small leaks.

FIG. 2B shows a cross sectional view of the middle stinger (204). The middle stinger (204) is configured to be retained within the retainer aperture (214). The middle stinger exterior peripheral surface (216) of the middle stinger (204) is designed to seat flush within the retainer aperture (214) as the retainer aperture (214) is machined into the cement retainer (102) to fit the geometry of the middle stinger exterior peripheral surface (216). The middle stinger exterior peripheral surface (216) may have at least one middle seal (224) portion configured to seal against the retainer aperture (214). The middle seal (224) may also be disposed around the middle stinger exterior peripheral surface (216).

The middle stinger (204) has a middle stinger bottom end (226) and a middle stinger top end (228). A middle stinger longitudinal axis (230) runs through the center of the middle stinger (204) from the middle stinger top end (228) to the middle stinger bottom end (226). The middle stinger (204) is made of a tubular body with a middle stinger aperture (238). The middle stinger aperture (238) extends longitudinally along the middle stinger longitudinal axis (230) from the middle stinger top end (228) to the middle stinger bottom end (226).

The middle stinger aperture (238) provides hydraulic access from the middle stinger top end (228) to the middle stinger bottom end (226). The middle stinger aperture (238) is shaped such that when the upper stinger (206) is inserted into the middle stinger aperture (238), an upper stinger exterior peripheral surface (234) fits flush against the middle stinger aperture (238). This may mean that the middle stinger aperture (238) has different diameters and various geometries to seat the upper stinger (206).

The unidirectional valve (202) is housed within the middle stinger aperture (238). FIG. 2B shows the unidirectional valve (202) in a closed position. In its closed position, the unidirectional valve (202) is seated approximately perpendicular to the middle stinger longitudinal axis (230). The unidirectional valve (202) is configured to selectively control flow of fluid through the middle stinger aperture (238). This means that the unidirectional valve (202) allows fluid movement in the downhole (128) direction from the middle stinger top end (228) to the middle stinger bottom end (226), and the unidirectional valve (202) restricts fluid flow in the up hole (130) direction from the middle stinger bottom end (226) to the middle stinger top end (228). The unidirectional valve (202) may have a rupture disk. The rupture disk is designed to rupture, or break, when a pre-set pressure is seen across the rupture disk. The rupture disk may be added to the unidirectional valve (202) as an extra precaution against any up hole (130) fluid flow.

FIG. 2C shows a cross sectional view of the upper stinger (206). The upper stinger (206) is configured to be removably retained within the middle stinger aperture (238). The upper stinger (206) is able to be removed from the middle stinger aperture (238) by applying a pre-set pick-up weight on the assembly (200). The pick-up weight to remove the upper stinger (206) from the middle stinger (204) is less than the pick-up weight that would be required to remove the middle stinger (204) from the cement retainer (102) or the pick-up weight required to remove the cement retainer (102) from the concentric tubing member in which the cement retainer (102) is set.

The upper stinger exterior peripheral surface (234) is designed to seat flush within the middle stinger aperture (238) as the middle stinger aperture (238) is machined into the middle stinger (204) to fit the geometry of the upper stinger (206). The upper stinger exterior peripheral surface (234) may have at least one upper seal (240) portion configured to seal against the middle stinger aperture (238). The upper seal (240) may also be disposed around the upper stinger exterior peripheral surface (234).

The upper stinger (206) has an upper stinger bottom end (242) and an upper stinger top end (244). An upper stinger longitudinal axis (246) runs through the center of the upper stinger (206) from the upper stinger top end (244) to the upper stinger bottom end (242). The upper stinger (206) is made of a tubular body with an upper stinger aperture (248). The upper stinger aperture (248) extends longitudinally through the upper stinger (206) along the upper stinger longitudinal axis (246) from the upper stinger top end (244) to the upper stinger bottom end (242). The upper stinger aperture (248) provides hydraulic access from the upper stinger top end (244) to the upper stinger bottom end (242). The upper stinger aperture (248) may be cylindrical-shaped.

The upper stinger (206) has an opening (250) located at a bottom portion of the upper stinger bottom end (242). There also may be a plurality of circulation valves (252) oriented around the upper stinger exterior peripheral surface (234). When the upper stinger (206) is removed from the middle stinger (204), the opening (250) and the circulation valves (252) allow fluid to flow into the upper stinger aperture (248) from the outside of the upper stinger (206). For example, the opening (250) and the circulation valves (252) may provide a fluid flow path from the third segment (134) of the casing string (108) to the upper stinger aperture (248) when the upper stinger (206) is removed from the middle stinger (204).

FIG. 2D shows the assembly (200) that is formed by the installation of the middle stinger (204) and the upper stinger (206) into the cement retainer (102). The middle stinger (204) is fixed within the cement retainer (102) by inserting the middle stinger bottom end (226) into the retainer top end (210). The upper stinger (206) is fixed within the middle stinger (204) by inserting the upper stinger bottom end (228) into the middle stinger top end (228) to form the assembly (200). The middle seals (224) of the middle stinger (204) may seal against the retainer aperture (214). The upper seals (240) of the upper stinger (206) may seal against the middle stinger aperture (238). Further, the middle stinger exterior peripheral surface (216) may be flush against the retainer aperture (214), and the upper stinger exterior peripheral surface (234) may be flush against the middle stinger aperture (238).

FIG. 2D shows the unidirectional valve (202) in the open position. As the upper stinger (206) is inserted into the middle stinger (204), the upper stinger bottom end (242) may press against the unidirectional valve (202) to open the unidirectional valve (202). With the unidirectional valve (202) in the open position, the assembly (200) is hydraulically connected in the downhole (128) direction and the up hole (130) direction. In other embodiments, the upper stinger bottom end (242) may not reach or touch the unidirectional valve (202) and the unidirectional valve (202) may open when a fluid is pumped against the unidirectional valve (202) in the downhole (128) direction.

Examples of use and operation of the assembly (200) will now be described with reference to FIGS. 3A-3B, FIGS. 4A-4B, and the flowchart of FIG. 5.

Figure 3A:
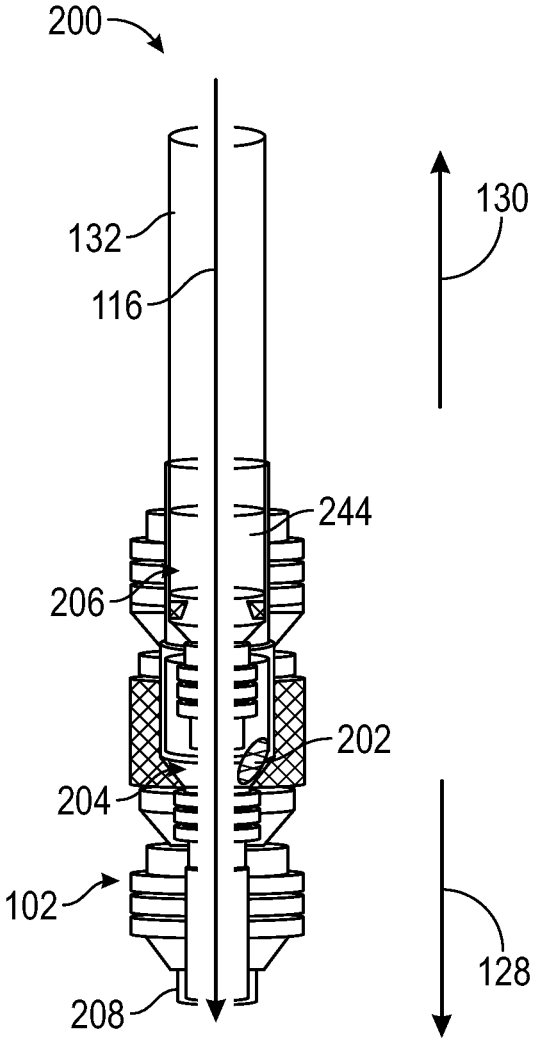
FIGS. 3A and 3B show a system using the assembly in accordance with one or more embodiments.
Figure 3B:
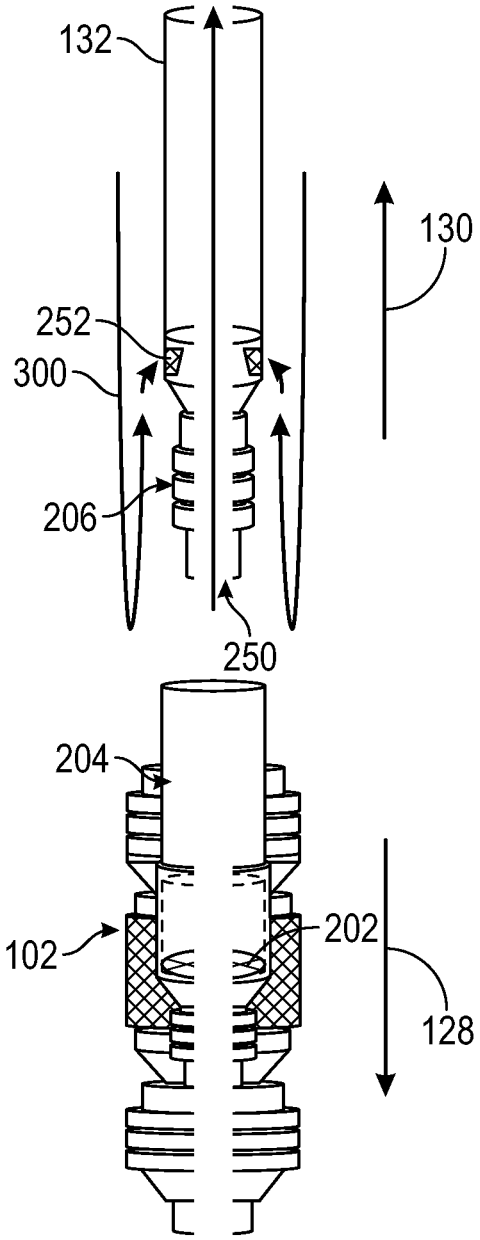

FIGS. 3A and 3B show how a fluid (300) or a cement (116) may be circulated throughout the components of the assembly (200). The tubing string (132) is connected to the upper stinger top end (244). FIG. 3A shows the upper stinger (206) inserted into the middle stinger (204). FIG. 3B shows the upper stinger (206) removed from the middle stinger (204). Components of FIGS. 3A and 3B that are the same as or similar to components shown in FIGS. 1-2D have not been redescribed for purposes of readability and have the same purpose as described above.

Specifically, FIG. 3A shows the unidirectional valve (202) in the open position. The unidirectional valve (202) is opened due to the insertion of the upper stinger (206) into the middle stinger (204). A fluid, such as cement (116), is shown being pumped into the assembly (200) through the tubing string (132) in the downhole (128) direction. The cement (116) enters the assembly (200) through the upper stinger top end (244) of the upper stinger (206) and exits the assembly (200) through the retainer bottom end (208) of the cement retainer (102).

FIG. 3B shows the unidirectional valve (202) in the closed position. The unidirectional valve (202) is closed due to the removal of the upper stinger (206) from the middle stinger (204). A fluid (300), such as water, drilling mud, completion fluid, etc., is shown being reverse circulated into the tubing string (132). The fluid (300) enters the tubing string (132) through the opening (250) and the circulation valves (252) of the upper stinger (206). The fluid (300) flows in the up hole (130) direction through the tubing string (132).

Figure 4A:
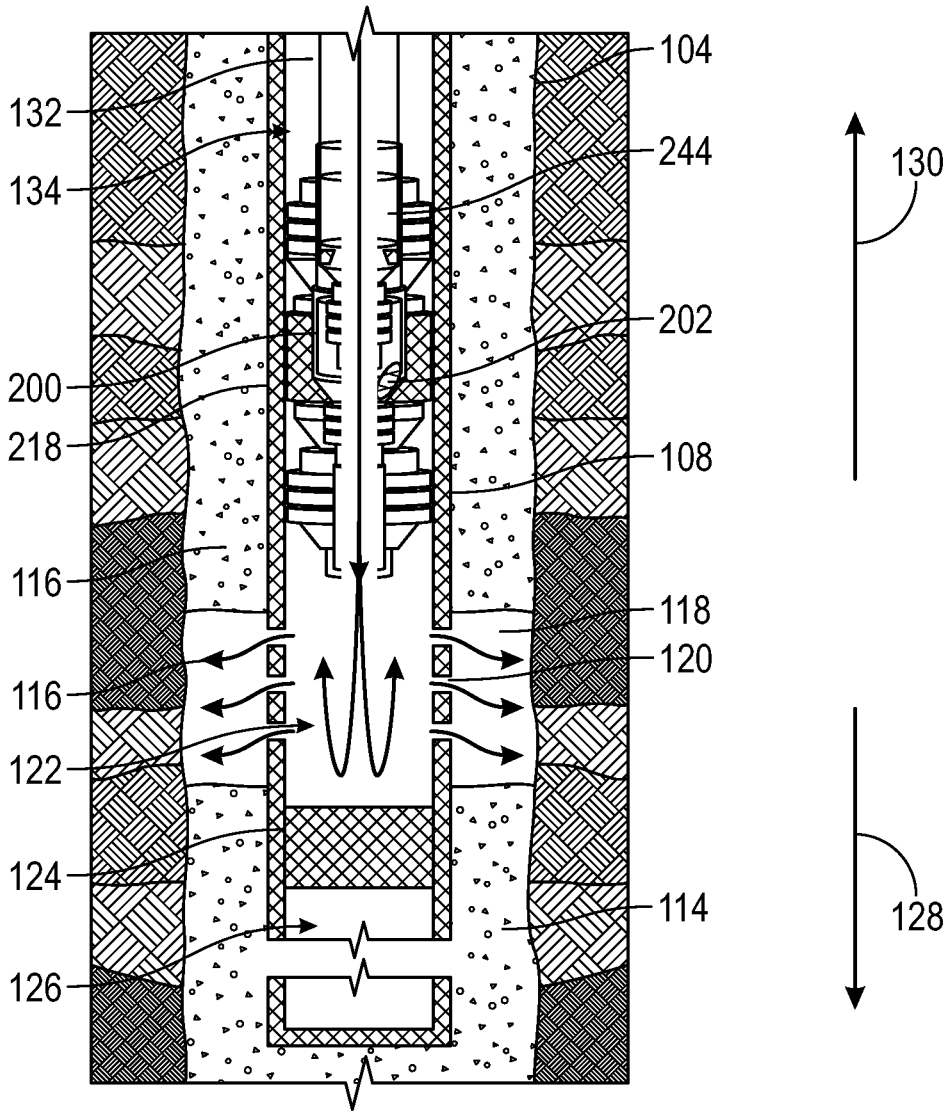
FIGS. 4A and 4B show a system using the assembly in accordance with one or more embodiments.
Figure 4B:
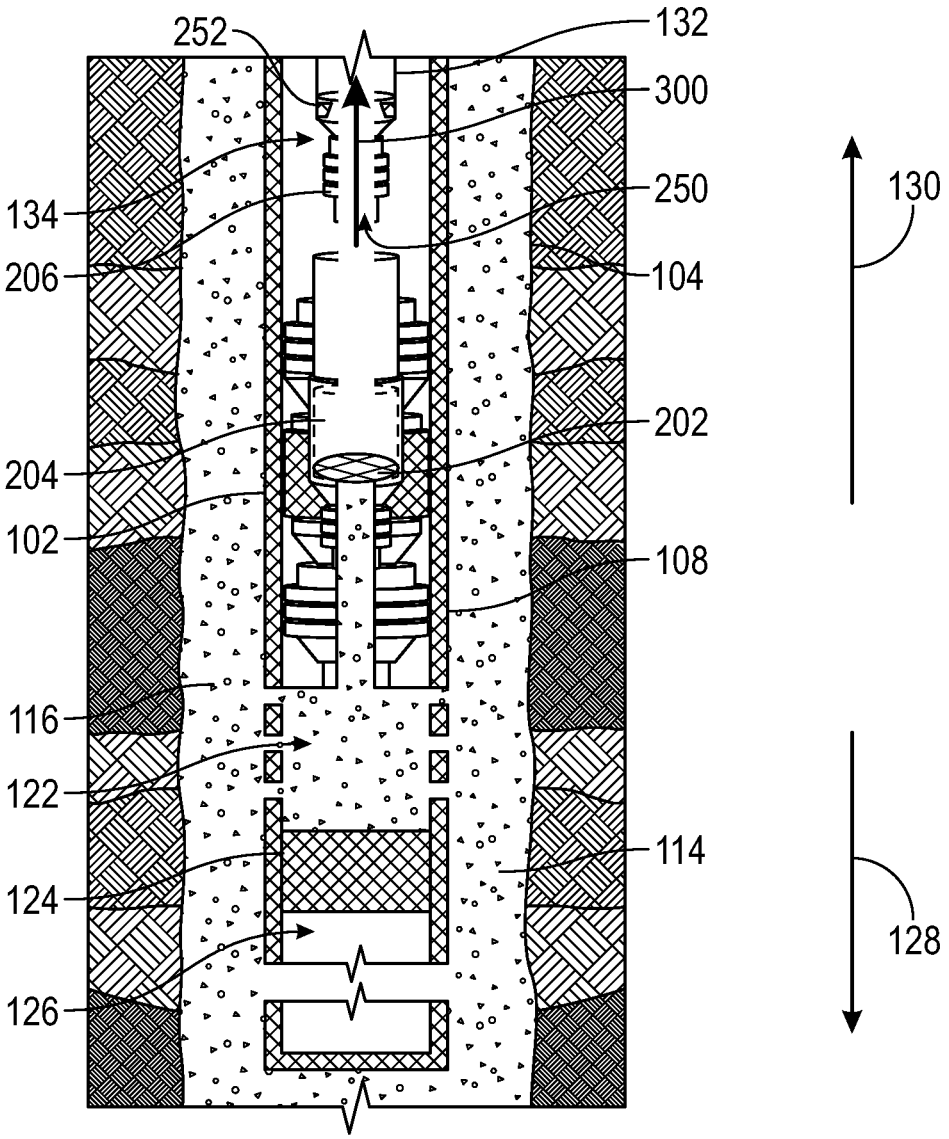

FIGS. 4A and 4B show the well system (100) depicted in FIG. 1 with the assembly (200) of FIG. 2D used as the cement retainer (102). As such, components of FIGS. 4A and 4B that are the same as or similar to components shown in FIGS. 1-3B have not been redescribed for purposes of readability and have the same purpose as described above. Specifically, FIG. 4A shows the system depicted in FIG. 1 with the assembly (200) as shown in FIG. 3A while cement (116) is being pumped into the portion (118) of the annulus (114) for cement remediation. FIG. 4B shows the system depicted in FIG. 1 with the assembly (200) as shown in FIG. 3B during the reverse circulation of the tubing string (132).

Turning to FIG. 4A, the tubing string (132) is connected to the upper stinger top end (244) and extends to the surface location. The assembly (200) has been tripped into the casing string (108) and disposed within the casing string (108) up hole (130) from the portion (118) of the annulus (114) void of cement (116) using the tubing string (132). The tubing string (132) is able to have the unidirectional valve (202) act as a well control mitigation due to the assembly (200) being attached to the tubing string (132). The unidirectional valve (202) allows flow in the downhole (128) direction and prevents flow in the up hole (130) direction. The assembly (200) has been set within the casing string (108), meaning that radially expandable sealing surface (218) of the cement retainer (102) has expanded and sealed against the interior surface of the casing string (108). The assembly (200), when set, isolates the first segment (122) of the casing string (108) from the third segment (134) of the casing string (108).

In some embodiments, the plug (124) has been disposed within the casing string (108) downhole from the portion (118) of the annulus (114) void of cement (116). Once the plug (124) is set, the first segment (122) is isolated from the second segment (126). However, the assembly (200) may be used to cement an annulus (114) of a casing string (108) without the plug (124) being disposed within the casing string (108). The presence of the plug (124) helps to limit the size of the first segment (122) that will be filled with cement (116). FIG. 4A shows cement (116) being pumped from the surface, through the inside of the tubing string (132) in the downhole (128) direction, through the assembly (200), out the retainer bottom end (208) of the assembly (200), into the first segment (122), through the perforations (120), and into the portion (118) of the annulus (114) void of cement (116).

After a desired amount of cement (116) has been placed into the portion (118) of the annulus (114), the tubing string (132), still connected to the upper stinger top end (244) of the upper stinger (206), is pulled out of the assembly (200) leaving behind the middle stinger (204), the unidirectional valve (202), and the cement retainer (102). The tubing string (132) undergoes reverse circulation to clear the inside of the tubing string (132) of cement (116). Because the unidirectional valve (202) is left in the middle stinger (204), the cement (116) is able to flow through the tubing string (132) in the up hole (130) direction. As such, FIG. 4B shows the system after the tubing string (132) and the upper stinger (206) have been removed leaving behind the unidirectional valve (202) in the middle stinger (204).

FIG. 4B also shows the tubing string (132) undergoing reverse circulation. Fluid (300) is pumped into the third segment (134) of the casing string (108). The fluid (300) enters the tubing string (132) through the opening (250) and the circulation valves (252) of the upper stinger (206). The fluid (300), along with the left-over cement (116), is pushed in the up hole (130) direction through the inside of the tubing string (132) to circulate the cement (116) out of the tubing string (132) to the surface location.

Figure 5:
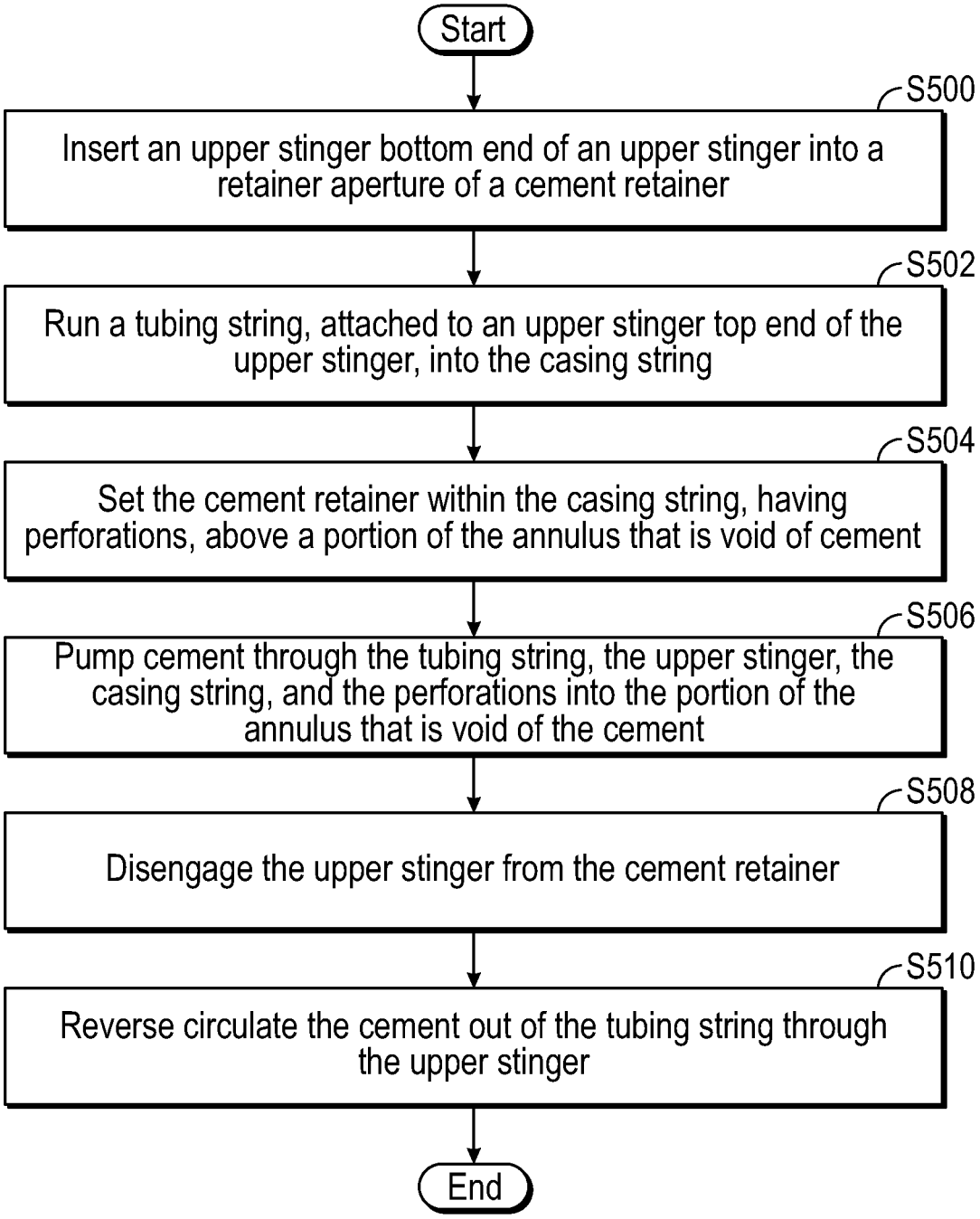
FIG. 5 shows a flowchart in accordance with one or more embodiments.

FIG. 5 depicts a flowchart in accordance with one or more embodiments. More specifically, FIG. 5 illustrates a method for cementing an annulus (114) of a casing string (108). Further, one or more blocks in FIG. 5 may be performed by one or more components as described in FIGS. 1-4B. While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

An assembly (200) is formed by inserting an upper stinger bottom end (242) of an upper stinger (206) into a retainer aperture (214) of a cement retainer (102) (S500). In further embodiments, a middle stinger bottom end (226) of the middle stinger (204), having a unidirectional valve (202), is inserted into a retainer top end (210) of the cement retainer (102). The unidirectional valve (202) may be a float valve that only allows fluid to flow in a singular direction.

The upper stinger bottom end (242) of the upper stinger (206) may be inserted into a middle stinger top end (228) of the middle stinger (204) after the middle stinger (204) is already inserted into the retainer aperture (214). An upper stinger top end (244) of the upper stinger (206) may be attached to a tubing string (132). Thus, the assembly (200) is attached to the tubing string (132). The tubing string (132) is run into a casing string (108) (S502). Fluid is prevented from flowing in the up hole (130) direction from the middle stinger bottom end (226) to the middle stinger top end (228), through the tubing string (132), using the unidirectional valve (202).

The casing string (108) is located in a wellbore (104) drilled into a formation (106). The casing string (108) has an annulus (114) that is partially filled with cement (116); however, a portion (118) of the annulus (114) is void of cement (116). The assembly (200) is run into the casing string (108) to place cement in this portion (118) of the annulus (114). The cement retainer (102) is set within the casing string (108), having perforations (120), above (i.e., up hole (130) from) the portion (118) of the annulus (114) void of cement (116) (S504). The cement retainer (102) isolates a first segment (122) of the casing string (108) from a third segment (134) of the casing string (108).

The perforations (120) are located across the first segment (122) of the casing string (108). The cement retainer (102) is set by expanding the radially expandable sealing surface (218) of the cement retainer (102) and sealing the radially expandable sealing surface (218) against the inner surface (110) of the casing string (108). A plug (124) may be set within the casing string (108) beneath the portion (118) of the annulus (114) void of cement (116). The plug (124) would be set prior to the assembly (200) being run into the casing string (108). The plug (124) may be a packer. The plug (124) isolates the first segment (122) from the second segment (126) of the casing string (108).

Cement (116) is pumped through the tubing string (132), the upper stinger (206), the casing string (108), and the perforations (120) into the portion (118) of the annulus (114) void of cement (116) (S506). When the planned amount of cement (116) has been pumped, the upper stinger (206) is disengaged from the middle stinger (204) (S508). The cement (116) is reverse circulated out of the tubing string (132) through the upper stinger (206) (S510) by pumping a fluid (300) into the casing string (108). The fluid (300) may then enter the tubing string (132) through the opening (250) and the circulation valves (252) of the upper stinger (206).

Embodiments disclosed herein discussed using the disclosed assembly (200) as a cementing tool, however the assembly (200) may be used to place any type of liquid into a well. Further, the assembly (200) may be used within a casing string (108), a liner, or a completion tubing string. The casing string (108) in which the assembly (200) may be used, may be one of many casing strings (108) in a wellbore (104). The assembly (200) and plug (124) method may be used to place cement (116) in an annulus (114) that is located near the top, middle, or bottom of a casing string (108). Further, the portion (118) of the annulus (114) may not be completely void of cement (116). The cement (116) may encroach into the portion (118) of the annulus (114) without departing from the scope of this disclosure herein.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for cementing an annulus of a casing string, wherein a portion of the annulus is void of cement and a portion of the casing string has perforations in fluid communication with the portion of the annulus, the method comprising:

inserting an upper stinger bottom end of an upper stinger into a retainer aperture of a cement retainer, wherein a unidirectional flow valve is located within the retainer aperture;

running a tubing string, attached to an upper stinger top end of the upper stinger, into the casing string;

setting the cement retainer within the casing string above the portion of the annulus that is void of cement;

pumping cement through the tubing string, the upper stinger, the casing string, and the perforations into the portion of the annulus that is void of the cement;

disengaging the upper stinger from the cement retainer; and reverse circulating the cement out of the tubing string through the upper stinger.

2. The method of claim 1, further comprising:

setting a plug within the casing string beneath the portion of the annulus that is void of the cement.

3. The method of claim 1, wherein running the tubing string into the casing string further comprises allowing flow of fluid in a first direction and preventing flow of fluid in a second direction, through the tubing string, using the unidirectional flow valve.

4. The method of claim 1, wherein reverse circulating cement out of the tubing string through the upper stinger further comprises pumping a fluid into the casing string.

5. The method of claim 4, wherein the fluid enters the upper stinger through an opening.

* * * * *